US010711458B2

(12) United States Patent
Züllig

(10) Patent No.: US 10,711,458 B2
(45) Date of Patent: Jul. 14, 2020

(54) WALL CONSTRUCTION PANEL AND WALL CONSTRUCTION SYSTEM FOR EXHIBITION CONSTRUCTION

(71) Applicant: Syma Intercontinental AG, Kirchberg (CH)

(72) Inventor: Kurt Züllig, Kirchberg (CH)

(73) Assignee: Syma Intercontinental AG (CH)

( * ) Notice: Subject to any disclaimer, the term of this patent is extended or adjusted under 35 U.S.C. 154(b) by 251 days.

(21) Appl. No.: 15/751,852

(22) PCT Filed: Aug. 8, 2016

(86) PCT No.: PCT/EP2016/068883

§ 371 (c)(1),
(2) Date: Mar. 12, 2018

(87) PCT Pub. No.: WO2017/025508

PCT Pub. Date: Feb. 16, 2017

(65) Prior Publication Data

US 2018/0230694 A1 Aug. 16, 2018

(30) Foreign Application Priority Data

Aug. 10, 2015 (EP) ..... 15180426

(51) Int. Cl.
*E04B 2/72* (2006.01)
*E04B 2/74* (2006.01)
(Continued)

(52) U.S. Cl.
CPC ..... *E04B 2/766* (2013.01); *E04B 2/72* (2013.01); *E04B 2/74* (2013.01); *E04B 2/7407* (2013.01);
(Continued)

(58) Field of Classification Search
CPC . E04B 2/72; E04B 2/74; E04B 2/7407; E04B 2/7425; E04B 2/789
See application file for complete search history.

(56) References Cited

U.S. PATENT DOCUMENTS 5,058,347 A * 10/1991 Schuelke ..... E04B 2/7425 160/135
2004/0244317 A1* 12/2004 Tan ..... E04B 2/7425 52/204.1
2006/0107606 A1* 5/2006 Remelts ..... E04B 2/7425 52/204.1

FOREIGN PATENT DOCUMENTS

DE 20 2010 006529 U1 9/2010
EP 2392742 A2 * 12/2011 ..... E04B 2/7433
WO WO-2009000390 A1 * 12/2008 ..... F16B 7/046
WO WO-2016110375 A1 * 7/2016 ..... E04B 2/74

* cited by examiner

OTHER PUBLICATIONS

EP2392742A2 English Translation (Year: 2011).*
European Patent Office, International Search Report for PCT application No. PCT/EP2016/06883, dated Sep. 29, 2016.

*Primary Examiner* — Kyle R Grabowski
(74) *Attorney, Agent, or Firm* — Cahn & Samuels, LLP

(57) ABSTRACT

A wall construction panel 1 for the setting up of walls for exhibition stand construction includes four frame elements 2, 3, 4, each of which having a groove and being connected to a rectangular frame with a peripheral frame groove pointing to the frame inside. The frame groove is formed by the grooves of the frame elements 2, 3, 4 and a panel 5 is inserted into the frame groove. Two of the four frame elements 2, 3, 4 are configured as frame elements 2, 3 extending in a vertical direction Y, one of which is configured as a pillar element 2 and the other one as an edge element 3. Two others of the four frame elements 2, 3, 4 are configured as framework elements 4 extending in a horizontal direction X where each of the framework elements 4
(Continued)

bears with a horizontal end on the pillar element 2 and the edge element 3 is placed with a first horizontal section 31 between the framework elements 4 and projects with a second horizontal section 32 horizontally over the framework elements 4. The edge element 3 is formed by a one-piece metal or plastic element and has a cross-section configured as a U-shape perpendicularly to the vertical direction Y, wherein the U-shape is open towards the frame inside and is formed by two side walls 30 that are spaced from each other throughout the first horizontal section 31 and that are connected with each other exclusively in the second horizontal section 32, wherein the edge element 3 has in the second horizontal section 32 a maximal width in a transverse direction Z, that is perpendicular to both the horizontal direction and the vertical direction, that is less than a width of the groove of the pillar element 2 in the transverse direction Z, wherein in particular the pillar element 2 has at least one receiving groove that is configured identical to the groove of the pillar element 2 into which the panel 5 is inserted.

19 Claims, 3 Drawing Sheets

(51) Int. Cl.
*E04B 2/76* (2006.01)
*E04B 2/78* (2006.01)

(52) U.S. Cl.
CPC ..... *E04B 2/7425* (2013.01); *E04B 2/789* (2013.01); *E04B 2/7836* (2013.01)

WALL CONSTRUCTION PANEL AND WALL CONSTRUCTION SYSTEM FOR EXHIBITION CONSTRUCTION

This application is the National Stage of International Application No. PCT/EP2016/068883, filed on Aug. 8, 2016, which claimed the benefit of EPO Application No. 15180426.7 filed Aug. 10, 2015, which are hereby both incorporated by reference.

This invention relates to a wall construction panel and a wall construction system for the setting up of walls in the field of exhibition stand construction. Conventionally, walls for exhibition stand construction are made of prefabricated single parts. Such walls are usually set up at fairs by companies specialized in this field. Such companies always make efforts to carry on the setting up of walls as quickly and at lowest possible costs so that they can fulfill the very high requirements in this respect that have to be met by exhibition organizers.

For example, wall panels systems are known that comprise horizontal framework parts, vertical pillar elements and panels as prefabricated parts. The pillar elements and framework elements are usually manufactured as extrusions made of aluminum and have a constant cross-section throughout their longitudinal extension. The pillar elements usually have a polygonal cross-section, for example a square cross-section or a cross-section in the manner of a regular octagon. On each side that is limited by two corners of the cross-section, the pillar elements have an identical groove that also extends over the whole longitudinal extension of the pillar element. The framework elements usually have a hollow profile area extending over their entire longitudinal extension as well as a groove, at least on one side, that often is also identical to the grooves of the pillar elements. At each end of their longitudinal extension, the frameworks usually have clamp connectors that are inserted in the hollow profile area. A pressboard or a glass plate is used as a panel. The setting up of walls is carried out with these prefabricated single parts as follows. Two framework elements are mounted on one side of a pillar element on which there is a groove in such a manner that the grooves of the framework elements converge with the groove of the pillar element and that the clamp connectors placed at the ends of the framework elements that point to the pillar element penetrate sectionwise into the groove of the pillar element. The fixing of the framework elements to the pillar elements takes place with the clamp connectors. A skilled person knows different embodiments of the clamp connectors, for example eccentric clamp connectors that get stuck with the groove of the pillar element. The panel is then pushed into the grooves of the framework elements and into the groove of the pillar element, whereupon a further pillar element is then fixed at the free end of the framework elements as described, wherein the groove of this pillar element also receives the panel. Further framework elements can be fixed, as described, on the free sides of the pillar elements, wherein each pillar element has free grooves so that a wall with any length can be produced. The known wall construction system that has been described makes possible a very variable setting up of walls and can simultaneously be cost-effectively produced since only a small number of different single parts are required. However, the drawback of this wall construction system is that the setting up of walls for exhibition stands on site at the fair is time-consuming since the walls have to be produced from a multitude of single parts.

For example, wall construction systems are also known for which wall construction panels are produced as prefabricated parts that are then assembled at the fair for the setting up of walls. Such a wall construction system is disclosed, for example, in DE 20 2010 006 529. The wall construction panels are produced from a conventional pillar element and two conventional framework elements as well as an edge profile element instead of the second pillar element. The edge profile element is placed between the horizontal frames so that the ends of the framework elements that are opposite the pillar element remain free so that the pillar element of a further wall construction panel can be set with one side on which it has a free groove, as described above, on the framework elements and can be fixed with the framework elements by the clamp connectors of the framework elements. A fixation of the edge profile element to the framework elements is necessary for the inherent stability of such wall construction panels. Furthermore, the panel of a wall construction panel has to be sufficiently well maintained on the edge profile element. Moreover, the edge profile element has to provide a spring that can engage into the groove of a mounted pillar element of a further wall construction panel so that two prefabricated wall construction panels can be connected with each other in a sufficiently stable manner. For the wall construction system described as an example, the described aims are achieved in that the edge profile element has, on the one hand, a groove element in which the panel is placed, adjacent to the groove element of a hollow profile area into which conventional clamp connectors are inserted, for connecting the edge profile element with the framework elements as well as further comprises, on the side of the hollow profile area that is opposite the groove element, a spring element that can be inserted into the groove of the pillar element of a further wall construction panel. The wall construction system described makes possible, by providing sufficiently stable prefabricated wall construction panels, a quick setting up of walls at a fair. However, the edge profile element with the different sections, namely the groove element, the hollow profile area for receiving a clamp connector and the spring element, must have very large dimensions, in particular since a sufficiently big and stable hollow profile area and sufficiently stable groove and spring elements mounted thereon have to be provided. The production of the edge profile element is thus elaborate and requires a large amount of material which is all the more significant that the edge profile element constitutes an additional component that is not necessary for the other described known wall construction systems. Moreover, further clamp connectors are necessary for connecting the edge profile element with the framework elements, which further increases the costs of the wall construction system. The drawback of this wall construction system consisting in that the costs for the production of the single parts necessary for the wall construction system are high is opposed to the advantage of this wall construction system consisting in being able to realize more quickly the setting up of walls at a fair.

The aim of this invention is to make available a wall construction panel and a wall construction system that at least partially eliminates the drawbacks of conventional wall construction systems that have been described above and that makes possible a setting up of walls at a fair as quickly and simultaneously as cost-effectively as possible.

As a solution to said technical aim, this invention proposes a wall construction panel that includes four frame elements, each of which having a groove and that are connected to a rectangular frame with a peripheral frame groove pointing to the frame inside, wherein the frame groove is formed by the grooves of the frame elements and a panel is inserted into the frame groove. The four frame elements thus form a frame in the frame inside of which the panel is placed. The four frame elements thus enclose the panel. The panel is placed in the grooves of the four frame elements and the four frame elements are fixed with each other by fixing means so that the panel is securely held in the frame formed by the four frame elements. Conventional clamp connectors that are inserted in hollow profile areas of the framework elements, as explained with respect to the prior art, can be used, for example, as fixing means. A skilled person knows different possibilities for realizing such fixing means for connecting two frame elements. Two of the four frame elements are configured as frame elements extending in a vertical direction, one of which is configured as a pillar element and the other one as an edge element. The two others of the four frame elements are configured as framework elements extending in a horizontal direction, wherein the framework elements respectively bear with a horizontal end on the pillar element. The pillar element is thus placed in the horizontal direction besides the framework elements. The edge element is placed with a first horizontal section between the framework elements and projects with a second horizontal section horizontally over the framework elements. In the vertical direction, the edge element is thus placed between the framework elements, whereas it overlaps in the horizontal direction only with its first horizontal section with the two framework elements. It results from the described arrangement of the frame elements and of the panel that respectively one of the framework elements is placed at each vertical end of the panel and that the pillar element is placed at a first horizontal end of the panel and the edge element is placed at a second horizontal end of the panel. The pillar element and the edge element that both extend in the vertical direction are connected with each other by the framework elements that extend in the horizontal direction.

According to the invention, the edge element is formed by a one-piece metal or plastic element and has a cross-section configured with a U-shape perpendicularly to the vertical direction. The U-shape is open towards the frame inside and is formed by two side walls that are spaced from each other throughout the first horizontal section and that are connected with each other exclusively in the second horizontal section. While the U-shape is open towards the frame inside, the edge element makes available its groove for receiving the panel. The panel thus extends with a horizontal section between the side walls since the panel is placed in the groove of the edge element. The edge element has in the second horizontal section a maximal width in a transverse direction that is perpendicular to the horizontal direction and perpendicular to the vertical direction that is lower than a width of the groove of the pillar element in the transverse direction. The edge element has at most the maximal width over the whole second horizontal section, i.e. also over its whole extension in the vertical direction. In an embodiment, the edge element has on the whole at most the maximal width. In particular, the wall construction panel can be configured in such a manner that the groove of the pillar element is at no point as wide as the maximal width of the edge element in the second horizontal section, i.e. the minimal width of the groove of the pillar element can be lower than the maximal width of the edge element in the second horizontal section. The expression "groove of the pillar element" of course always refers to the groove in which the panel is placed. Particularly preferably, the pillar element has at least one receiving groove that is configured identical to the groove of the pillar element in which the panel is placed. The receiving groove thus designates a free groove of the pillar element in which the panel of the wall construction panel is not placed. The receiving groove can thus receive a section, in particular the second horizontal section of the edge element of a further wall construction panel so that, as in the prior art, two wall construction panels can be arranged adjacent to each other for implementing walls for exhibition stand construction. Particularly preferably, all the four frame elements are configured as extrusions, in particular as extrusions of aluminum. The frame elements can thus be configured cheaply and very stable. Particularly preferably, all the frame elements have the same cross-section throughout their whole longitudinal extension, i.e. the framework elements over their extension in the horizontal direction and the pillar element and the edge element over their extension in the vertical direction.

The wall construction panel according to the invention can be produced very cost-effectively since the edge element has a very simple design. The inventors realized that the U-shaped edge element has, due to its U-shape, a sufficient stiffness so that a sufficiently non-distortable rigid wall construction panel can be produced that can be transported without being damaged and that can be joined to further wall construction panels. Moreover, the inventors realized that the one-piece and homogeneously implemented U-shaped edge element simultaneously fulfills the function of a groove for receiving the panel and the function of a spring to be inserted in a receiving groove of a pillar element of an adjacent wall construction panel and that, in addition, the U-shaped edge element can be very easily connected to the framework elements in a sufficiently robust manner in different ways. For example, such a connection can be performed in that a screw is vertically screwed into the edge profile element through a feedthrough in a framework element so that the thread of the screw clamps with the side walls of the U-profile. For example, the edge element can extend with its first horizontal section into the groove of a framework element, wherein a fixation between the edge element and the framework element can be carried out by a screw that extends in the transverse direction and that extends through feedthroughs in the framework element and in the edge element. For example, T-pieces can be inserted into the U-shape of the edge element and be screwed with the side walls, wherein the connection between the framework element and the edge element can take place by screwing the T-piece with the framework element. This invention thus enables the implementation of a prefabricated wall construction panel for a wall construction system with minimal material costs and thus minimal production costs since the edge element can be produced very easily and with very low material costs. This contributes to the fact that the inventors realized that the edge element has a sufficient stability without providing a connection between the side walls in the first horizontal section of the edge element but that a connection of the side walls exclusively in the second horizontal section is sufficient, second horizontal section in which the side walls converge while forming the bottom of the U-shape.

In an embodiment, the grooves of the framework elements have respectively a width in the transverse direction that is less than the maximal width of the edge element in the transverse direction. In particular, the minimal width of the grooves of the framework elements is respectively less than the maximal width of the edge element. In particular, the grooves of the framework elements and the groove of the pillar element can be configured identical. The maximal width indicates the maximal extension of the edge element as a whole in the transverse direction. Due to the coordination of the widths of the grooves of the framework elements and that of the edge element, it can, for example, be made possible that the edge element extends with its first horizontal section in sections into the grooves of the framework elements so that an even better stability of the wall construction panel can be provided. Moreover, by providing a very low width of the edge element, even more material costs can still be saved. Moreover, by providing a very low width of the edge element, the edge element can fit very tightly against the panel, which can further stabilize the wall construction panel, and in particular which can also cause a visually pleasant impression of the wall construction panel. Particularly preferably, a vertical section of the first horizontal section of the edge element is placed in the groove of respectively one of the two framework elements. The edge element thus extends with a first vertical section of its first horizontal section in the groove of a first of the two framework elements and with a second vertical section of its first horizontal section in the groove of a second of the two framework elements. The wall construction panel can thus be implemented in a particularly stable way.

In an embodiment, the grooves of the pillar element and of the horizontal framework elements pointing to the inside of the frame are configured respectively as undercut grooves. The fixation of the framework elements and of the pillar elements with each other as well as the fixation of the framework elements with the edge element can thus still be improved since fixing means can grasp behind the undercut of the grooves. This being, it should be considered that an undercut groove is designed in such a manner that the width of the groove reduces over a section in direction to the frame inside so that a fixing element can be placed in the groove and can be prevented from sliding out of the groove due to the section of the groove in which the width of the groove reduces.

In an embodiment, the wall construction panel has two connecting elements, wherein the edge element is connected with the two framework elements by means of the two connecting elements, wherein each connecting element is associated to exactly one framework element and is placed with a first vertical holding section between the side walls of the edge element and is placed with a second vertical holding section inside the groove of the associated framework element. The first vertical holding section is thus placed in the transverse direction between the side walls of the edge element and in the horizontal direction besides the panel and in the vertical direction at least in sections at the level of the panel. The connecting element can thus be very easily fixed to the edge element with the first vertical holding section. For example, a screw or a clamping wedge or an adhesive fixation can be provided for that purpose. A very simple fixation of the connecting element with the associated framework element can be realized with the second vertical holding section that is placed in the groove of the framework element associated to the connecting element, for example with a screw, a clamping wedge or an adhesive fixation. Accordingly, the stable fixation between the associated framework element and the edge element can be reliably and simply realized with the connecting element that acts as a fixing means. By providing two connecting elements, each of which is associated to exactly one framework element, the connecting elements can be small and easily. On the one hand, this can simplify the fixation between the framework element, the connecting element and the edge element and on the other hand, the production costs can thus be kept low.

In an embodiment, at least for one of the connecting elements, in particular for all connecting elements, the first holding section is fixed with a separate first fixing means to the edge element and the second holding section is fixed with a separate second fixing means to the associated framework element. For example, screws, split pins or clamping wedges can be used as fixing means. By providing the two separate fixing means, the assembly of the wall construction panel can be particularly simplified and a very stable assembly of the wall construction panel is simultaneously made possible. In particular, at least one of the connecting elements, in particular all the connecting elements, have a cross-section configured as a T-shape perpendicularly to the horizontal direction, wherein the T-shape is formed by a base beam extending in the vertical direction and a crossbeam extending in the transverse direction, wherein the first holding section is configured as the base beam and the second holding section as the crossbeam. It results from the T-shape of the cross-section that the crossbeam projects beyond the base beam on both sides with respect to the transverse direction. The provision of the T-shaped connecting element implies the essential advantage that the base beam can be placed between the side walls of the edge element and can be fixed to them while the crossbeam is situated in the groove of an associated framework element so that, due to the considerable extension of the crossbeam, sufficient opportunity is given for fixing the crossbeam in the groove. The provision of the T-shaped connecting element thus involves a particularly simple and reliable fixation of the edge element and of the framework element to each other and simultaneously ensures a very easy implementation of the connecting element.

Particularly preferably, the first holding section of at least one of the connecting elements, in particular of all the connecting elements, has a bore that is aligned with a through-hole that is provided in a side wall of the edge element, wherein the connecting element is screwed to the edge element by means of a screw that extends through the hole and into the bore. For example, the bore can have an inner thread into which the screw is screwed. For example, each of the two side walls can have a through-hole, wherein the holes are aligned with each other and with the bore, wherein a screw extends through the holes and passes through the bore and a nut is screwed onto the screw so that both side walls are pressed against the first holding section. By providing the combination of a hole in a side wall and a bore aligned therewith in the connecting element and the fixation of the connecting element with a screw to the edge element, a very simple, cost-effective and stable fixation can be realized between the first holding section and the edge element. Particularly preferably, the connecting element has in its section, in which it has the bore, a thickness in the transverse direction of at least 3 mm, in particular of at least 4 mm. A sufficient stability of the connecting element at the level of the bore can thus be ensured. In particular, this can then be advantageous if the bore has an inner thread into which the screw is screwed since a sufficient fixation of the screw in the inner thread can then be ensured due to the sufficient thickness.

In an embodiment, for at least one of the connecting elements, in particular for all the connecting elements, the second holding section has a stepped extension in the transverse direction on its side pointing to the edge element. The groove of the framework element associated to this connecting element is limited, on its side pointing to the frame inside, by two undercut sections forming an undercut that extend in the transverse direction and that form a groove opening between them. The width of the groove thus increases starting from the groove opening along the vertical direction to the undercut sections. The undercut sections thus extend respectively from a groove wall to the groove opening. By providing the undercut sections, the groove is thus formed as an undercut groove. The second holding section of the connecting element is placed in the groove opening with a central section of its stepped extension and bears on the two undercut sections inside the groove with two lateral sections framing the central section. The stepped extension is thus formed by the step between a first lateral section and the central section and the step between a second lateral section and the central section. With the described embodiment, it is particularly advantageous that a fixation of the connecting element is ensured relative to the framework element with respect to the transverse direction by the stepped extension and the central section placed between the undercut sections. Particularly preferably, a fixing bore with an inner thread is provided in particular in the central section, fixing bore that extends in the vertical direction through the central section, wherein a fixing screw is screwed into the fixing bore, fixing screw that presses against a groove base facing the groove opening in the vertical direction so that the fixing screw presses the lateral sections against the undercut sections. A particularly reliable fixation of the second holding section relative to the framework element is thus ensured.

Particularly preferably, for the at least one connecting element the second holding section of which has the described stepped extension, a thickness in the transverse direction of the first holding section decreases in the vertical direction upwards to the second holding section over a step, wherein the fixing screw is placed in the vertical direction above the step and in the transverse direction at least in sections at the level of the step. It can thus be ensured, on the one hand, that the first holding section has a sufficient thickness so that a stable fixation of the first holding section relative to the edge element can be ensured. On the other hand, it can thus be ensured that the fixing screw can be placed in such a manner that it is accessible during assembly since it can be provided in the transverse direction at the level of the groove opening and the described pressing of the lateral sections of the second holding section against the undercut sections can thus be ensured by screwing the fixing screw into the fixing bore.

In an embodiment, a spacer is placed between the side walls of the edge element inside a vertical section of the edge element that extends over half the vertical extension of the edge element and that is spaced from the vertical ends of the edge element by respectively one fourth of this vertical extension and is fixed to the side walls. The spacer is spaced from the panel in the horizontal direction by less than 3 mm. In particular, the spacer can bear directly on the panel. The spacer can, for example, have a shape in the manner of a cuboid. For example, the spacer can have an extension length in the vertical direction of at least 50 mm, in particular of at least 100 mm. The spacer substantially increases the stability of the wall construction panel. The reason for this is that, without providing a spacer, the panel is spaced from the area in the second horizontal section of the edge element, at least over a substantial part of the vertical extension length of the edge element, while the side walls are connected with each other. For a load of the edge element in the horizontal direction towards the pillar element, without a spacer a deflection of the edge element may occur which can cause deformations of the wall construction panel. By providing the spacer, such a deflection is effectively impeded since the spacer, in an attempt of a deflection of the edge element towards the pillar element, bears on the panel and thus reduces a deflection of the edge element, if not even completely avoids. For example, the spacer can extend over the whole vertical section. For example, the spacer can also extend beyond the vertical section. It is essential that the spacer extends at least with a section inside the vertical section since the edge element is stressed by deflection particularly at the level of the vertical section, for example when carrying the wall construction panel.

In an embodiment, the framework elements have a hollow profile area extending throughout over their horizontal extension, wherein a clamp connector is placed and fixed on each of the two horizontal ends of the two framework elements. Both horizontal framework elements are connected with the pillar element respectively by one of their clamp connectors, namely by the clamp connector that is placed at the horizontal end at which the respective framework element bears on the pillar element. Thus, the clamp connectors act as fixing means. Both horizontal framework elements can be connected respectively by their other clamp connector with a further pillar element that has a receiving groove that is identical to the groove of the pillar element of the wall construction panel and that is adjacent to the framework elements with this receiving groove, wherein the edge element is placed with its second horizontal section in this receiving groove of this further pillar element. The horizontal framework elements can thus be connected to a pillar element of a further wall construction panel or can be fixed to the pillar element by their two other clamp connectors with which they are not connected to the pillar element of the wall construction panel, while the second horizontal section of the edge element is placed in the receiving groove of the pillar element of the further wall construction panel so that a very stable fixation of two wall construction panels can be ensured.

In an embodiment, the wall construction panel has a second edge element that is placed between the pillar element and the panel. For this embodiment, respectively one of the two edge elements thus directly bears at each horizontal end of the panel that extends in the vertical direction, while the one edge element simultaneously constitutes a vertical section of a horizontal end of the wall construction panel and projects with its second horizontal section over the framework elements and can be inserted into a receiving groove of a pillar element of a further wall construction panel, whereas the second edge element is inserted with its second horizontal section in the groove of the pillar element of the wall construction panel in which the panel of the wall construction panel is also inserted. The second horizontal section of the second edge element as well as the panel of the wall construction panel thus extends in the groove of the pillar element. As for the rest, the second edge element can be placed, as described above with respect to the first edge element, between the framework elements and/or fixed to the framework elements. However, it is also possible to refrain from any additional fixation between the second edge element and the framework elements since a sufficient stabilization of the wall construction panel can possibly be provided by the connection between the pillar element and the framework elements. Due to the very simple and low-cost assembly of the edge element, providing such a second edge element can be realized at very low additional costs.

Furthermore, the invention relates to a wall construction system comprising at least two wall construction panels according to the invention, wherein the pillar element of a first of the wall construction panels has a free receiving groove, wherein the edge element of a second wall construction panels is placed in the receiving groove of the pillar element of the first wall construction panel and wherein the framework elements of the second wall construction panel are connected with the pillar element of the first wall construction panel. The wall construction system according to the invention can be produced at low costs and makes possible a very quick setting up of walls at a fair.

Moreover, the invention relates to a method for producing a wall construction panel according to the invention. For the method according to the invention, in a first step, the framework elements are connected with the pillar element, in particular are fixed to the pillar element. In a second step, the panel is pushed in the horizontal direction into the grooves of the framework elements and into the groove of the pillar element. In a third step, a connecting element is respectively pushed in the horizontal direction into the groove of respectively one of the two framework elements and is fixed in the groove. In a fourth step, the edge element is pushed in the horizontal direction onto the connecting elements, whereupon the connecting elements are then fixed to the edge element. The method according to the invention makes possible a very simple and quick implementation of a wall construction panel according to the invention at low costs.

The invention shall be explained in detail below with reference to five figures by means of an exemplary embodiment.

Figure 1:
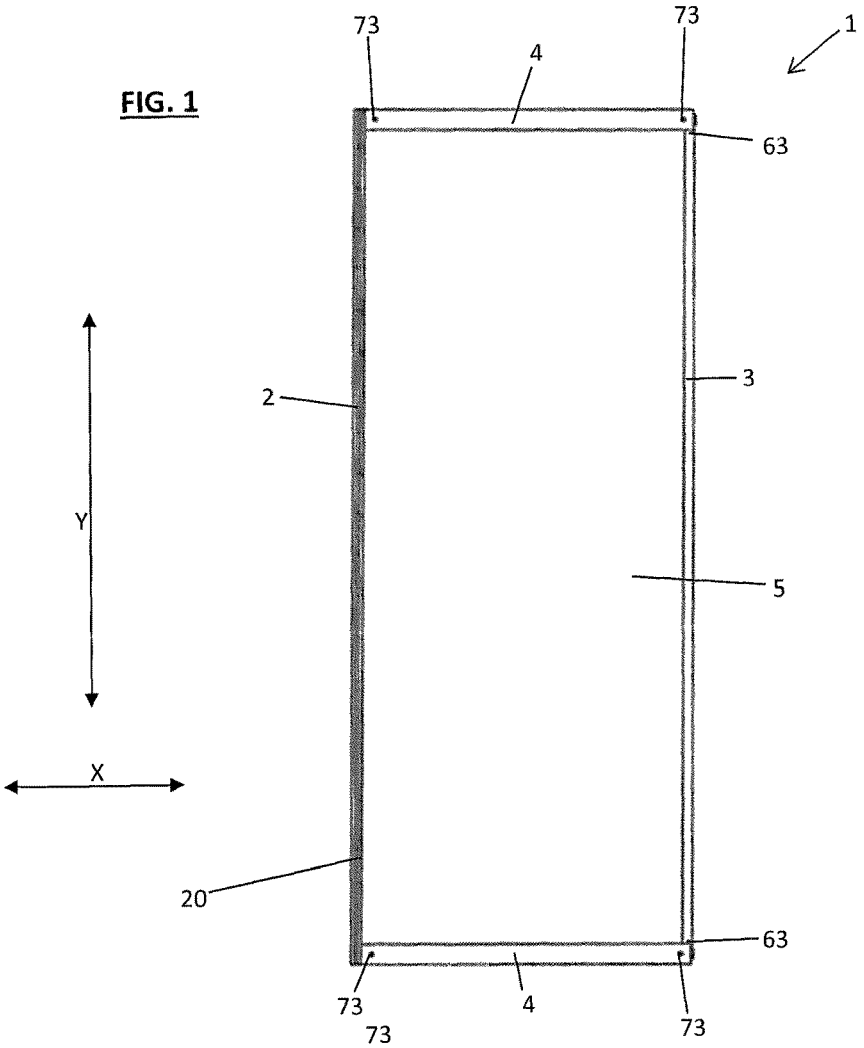
FIG. 1 shows a schematic diagram of a view of an embodiment of a wall construction panel according to the invention.

A view of an embodiment of a wall construction panel 1 according to the invention is represented as a schematic diagram. It can be recognized in FIG. 1 that the wall construction panel 1 comprises a pillar element 2, an edge element 3 and two framework elements 4 as four frame elements, wherein the pillar element 2 and the edge element 3 extend in the vertical direction Y and the framework elements 4 in the horizontal direction X. The four frame elements 2, 3, 4 thus form a rectangular frame that encloses a panel 5. This being, the pillar element 2 and the edge element 3 are connected with each other by the framework elements 4. The eccentric screws 73 of the eccentric clamp connectors 7 that are inserted in hollow profile areas of the framework elements 4 can be seen in FIG. 1, whereby this is represented in more detail in FIG. 5. The pillar element 2 is connected to respectively one of the framework elements 4 by respectively one eccentric clamp connector 7, wherein the connection is performed in that the eccentric clamp connector 7 is clamped by the eccentric screw 73 and widens in the groove of the pillar element 2 that is undercut. Moreover, two screws 63 with which respectively the first holding section of respectively one connecting element 6 is screwed to the edge element 3 can be seen in FIG. 1, this being represented in more detail in FIG. 4. Furthermore, it can be recognized in FIG. 1 that the pillar element 2 has a receiving groove 20 that extends in the drawing plane. A further wall construction panel can be connected with the pillar element 2 of the represented wall construction panel 1 with this receiving groove 20 for implementing a wall.

Figure 2:
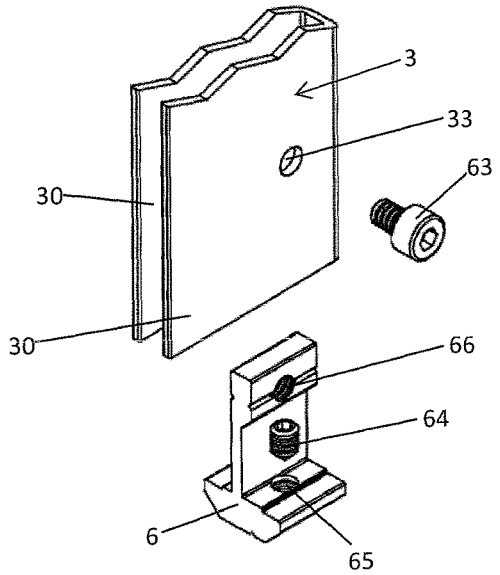
FIG. 2 shows a schematic exploded view of elements of the embodiment according to FIG. 1.

An exploded view of a section of the edge element 3 and of the connecting element 6 of the embodiment according to FIG. 1 is schematically represented in FIG. 2. It can be recognized in FIG. 2 that the edge element 3 has two side walls 30 that are connected with each other by forming the U-shape of the edge element 3. Furthermore, it can be recognized in FIG. 2 that a side wall 30 of the edge element 3 has a through-hole 33. The connecting element 6 has a cross-section configured as a T-shape perpendicularly to the horizontal direction X. The connecting element 6 is represented in more detail in FIG. 3. It can be recognized in FIG. 2 that the connecting element 6 can be inserted between the side walls 30 of the edge element 3 in such a manner that the bore 66 is aligned with the hole 33 so that the screw 63 can be screwed through the hole 33 into the inner thread that is provided in the bore 66 for fixing the connecting element 6 with the edge element 3. Moreover, it can be recognized in FIG. 2 that the connecting element 6 has a fixing bore 65 into which a fixing screw 64 can be screwed for pressing the connecting element 6 with an associated framework element 4.

Figure 3:
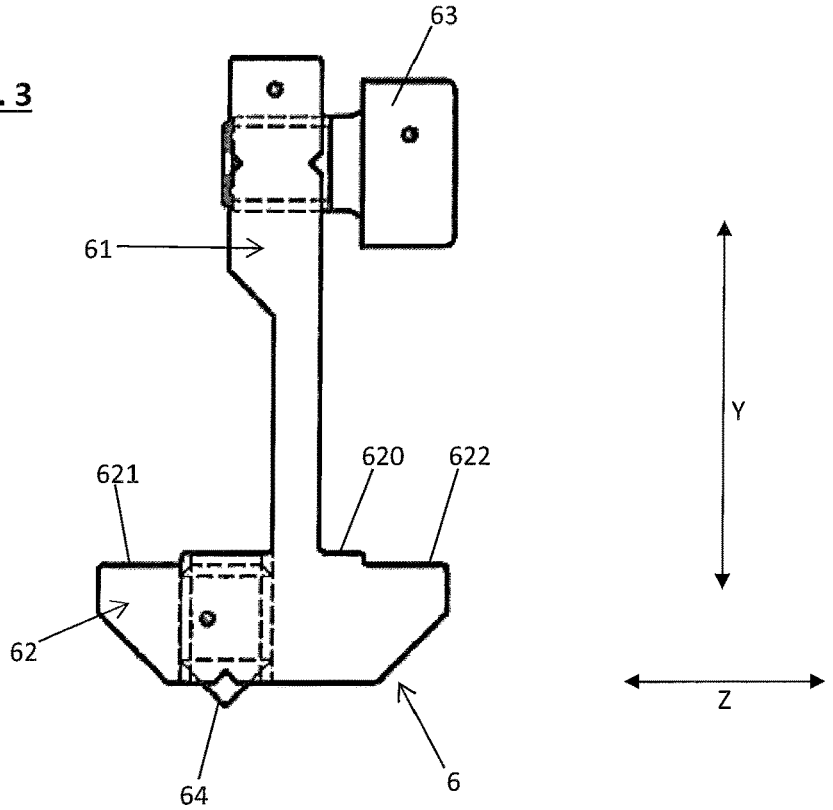
FIG. 3 shows a schematic diagram of a connecting element of the embodiment according to FIG. 1.

The connecting element 6 used in the embodiment according to FIG. 1 is schematically represented in detail in FIG. 3. It can be recognized in FIG. 3 that the connecting element 6 has a T-shaped cross-section perpendicularly to the horizontal direction X. The T-shape of the connecting element 6 is formed from a base beam 61 and a crossbeam 62. The base beam 61 has a section in which the bore 66 is placed into which the screw 63 is screwed. Starting from this section, the thickness of the base beam 61 reduces in the vertical direction Y towards the crossbeam 62 ("upwards") over a step, wherein this thickness reduces over the step. The crossbeam 62 has a stepped extension that is formed by the steps between the central section 620 and the two lateral sections 621, 622. The base beam 61 leads into the crossbeam 62 at the level of the central section 620. The fixing bore 65 in which the fixing screw 64 is placed is provided in the central section 620 and is placed in the vertical direction Y above the step of the base beam 61 and in the transverse direction Z in sections at the level of this step.

Figure 4:
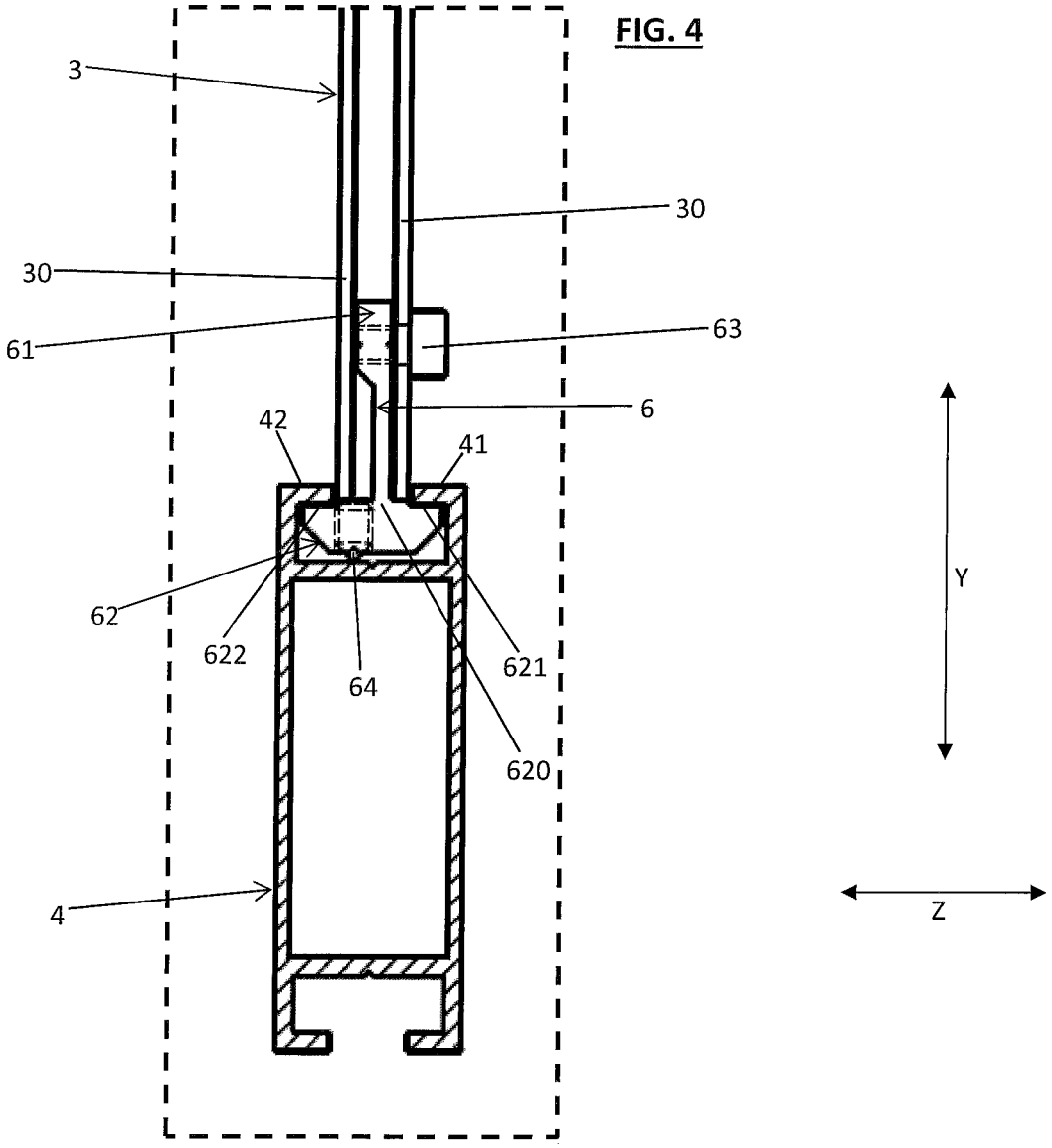
FIG. 4 shows a schematic diagram of the connection between a framework element and an edge element according to the embodiment according to FIG. 1.

FIG. 4 schematically shows the function of the connecting element 6 that is represented in detail in FIG. 3. The framework element 4 associated to the connecting element 6 is represented purely schematically in FIG. 4. A cutout of the edge element 3 is also represented purely schematically in sections in FIG. 4. Thus, for the sake of simplicity, the hollow profile area of the framework element 4 is represented in FIG. 4 but not a clamp connector placed in the hollow profile area. And also for the sake of simplicity, the connection of the side walls 30 of the edge element 3 is not represented in FIG. 4. However, it can be recognized in FIG. 4 that the connecting element 6 is placed with its first holding section that is configured as base beam 61, between the side walls 30 of the edge element 3 and is screwed with one of the side walls 30 by the screw 63. Furthermore, it can be recognized in FIG. 4 that the maximal width of the edge element 3 in the transverse direction Z is lower than the minimal width of the groove of the framework element 4 in the transverse direction Z. The edge element 3 is placed with a vertical section in the groove of the framework element 4, namely between the undercut sections 41, 42. The connecting element 6 is placed with its second holding section, that is configured as crossbeam 62, in the groove of the framework element 4, wherein the central section 620 is placed in the groove opening between the undercut sections 41, 42 and the lateral sections 621, 622 bear on the two undercut sections 41, 42 inside the groove. The fixing screw 64 is pressed against the bottom of the groove that is opposite the groove opening so that the fixing screw 64 presses the lateral sections 621, 622 against the undercut sections 41, 42. The connecting element 6 is thus very firmly fixed in the groove of the framework element 4 with its second holding section that is configured as crossbeam 62. A very solid fixation of the framework element 4 to the edge element 3 is thus ensured by the connecting element 6.

Figure 5:
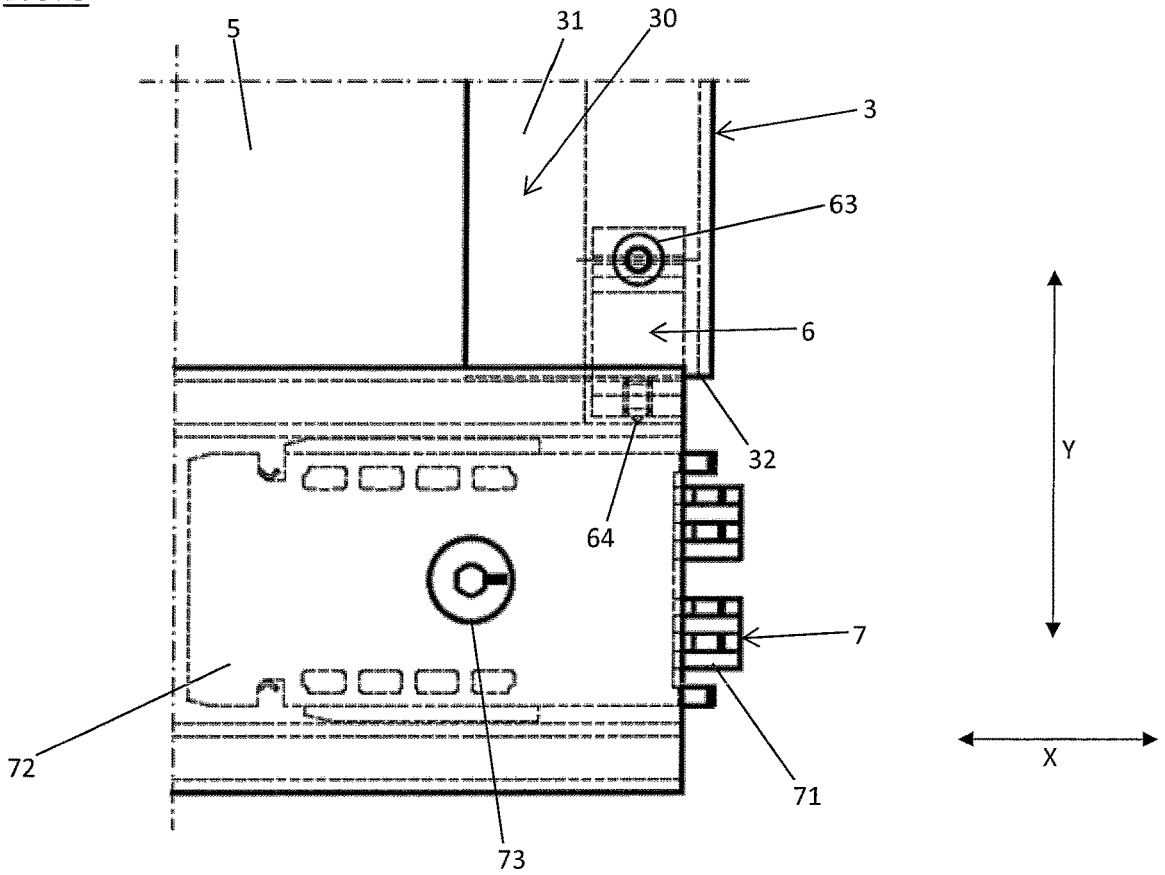
FIG. 5 shows a schematic diagram of a section of the embodiment according to FIG. 1.

A cutout of the embodiment according to FIG. 1, namely the lower corner on the right represented in FIG. 1, is represented in FIG. 5. The edges that extend in elements and that are not visible in the top view are represented in FIG. 5 as dashed lines. It can be recognized in FIG. 5 that an eccentric clamping connector 7 is placed in the hollow profile area of the framework element 4. The eccentric clamping connector 7 is placed with a connecting body 72 in the hollow profile area and projects with a clamping body 71 in the horizontal direction X beyond the framework element 4. Furthermore, the eccentric clamping connector 7 has an eccentric screw 73 with which the clamping mechanism of the clamping body 71 is actuated so that the clamping body 71 widens. Moreover, it can be recognized in FIG. 5 that the edge element 3 extends with its first horizontal section 31 between the framework elements 4 and thus extends horizontally along the framework elements 4 while it projects with its second horizontal section 32 in the horizontal direction X over the framework elements 4. The edge element 3 is, as explained above, connected by the connecting element 6 with the screw 63 and with the fixing screw 64 to the framework element 4. The wall construction panel 1 according to FIG. 1 can thus be joined to a further wall construction panel and connected therewith while the second horizontal section 32 is inserted into a receiving groove of the pillar element 2 of this further wall construction panel 1 and simultaneously the clamping body 71 of the eccentric clamping connector 7 is inserted into this receiving groove. A fixation between the framework element 4 and the further wall construction panel 1 or the pillar element 2 of the further wall construction panel 1 can be performed by the eccentric clamping connector 7 while the edge element 3 provides an additional fixation between the two wall construction panels 1 thanks to a second horizontal section 32 engaged into the receiving groove of the pillar element 2 of the further wall construction panel 1.

It results from the foregoing that the wall construction panel 1 according to the invention is very easily built up and can be implemented at low costs. Due to the interaction of its components, the wall construction panel 1 according to the invention simultaneously has a sufficiently high stability so that several wall construction panels 1 can be connected to each other without causing any damage to the wall construction panels 1. Moreover, the several wall construction panels 1 can be solidly fixed with each other, as it has been described.

LIST OF REFERENCE NUMERALS

1 Wall construction panel
2 Pillar element
3 Edge element
4 Framework element
5 Panel
6 Connecting element
7 Eccentric clamp connector
20 Receiving groove
30 Side wall
31 First horizontal section
32 Second horizontal section
33 Hole
41, 42 Undercut section
61 Base beam
62 Crossbeam
63 Screw
64 Fixing screw
65 Fixing bore
66 Bore
71 Clamping body
72 Connecting body
73 Eccentric screw
620 Central section
621 Lateral section
622 Lateral section
X Horizontal direction
Y Vertical direction
Z Transverse direction

The invention claimed is:

1. A wall construction panel (1) for the setting up of walls for an exhibition stand construction, the wall construction panel (1) comprising four frame elements (2, 3, 4), each of which having a groove and that are connected to form a rectangular frame with a peripheral frame groove pointing to the frame inside, wherein the frame groove is formed by the grooves of the frame elements (2, 3, 4) and a panel (5) is inserted into the frame groove, wherein two of the four frame elements (2, 3, 4) are configured as frame elements (2, 3) extending in a vertical direction (Y), one of which is configured as a pillar element (2) and the other one as an edge element (3), wherein the two others of the four frame elements (2, 3, 4) are configured as framework elements (4) extending in a horizontal direction (X), wherein each of the framework elements (4) bears with a horizontal end on the pillar element (2), wherein the edge element (3) is placed with a first horizontal section (31) between the framework elements (4) and projects with a second horizontal section (32) horizontally over the framework elements (4), wherein the edge element (3) is formed by a one-piece metal or plastic element and has a cross-section configured with a U-shape perpendicularly to the vertical direction (Y), the U-shape is open towards the frame inside and is formed by two side walls (30) that are spaced from each other throughout the first horizontal section (31) and that are connected with each other exclusively in the second horizontal section (32), the edge element (3) has in the second horizontal section (32) a maximal width in a transverse direction (Z), that is perpendicular to the horizontal direction and perpendicular to the vertical direction, that is less than a width of the groove of the pillar element (2) in the transverse direction (Z), and the pillar element (2) has at least one receiving groove that is configured to receive the second horizontal section (32) of the edge element (3) of a further wall construction panel (1).

2. The wall construction panel (1) according to claim 1, wherein the grooves of the framework elements (4) have respectively a width in the transverse direction (Z) that is less than the maximal width of the edge element (3) in the transverse direction (Z), wherein the grooves of the framework elements (4) and the groove of the pillar element (2) are configured identical.

3. The wall construction panel (1) according to claim 2, wherein respectively one vertical section of the first horizontal section (31) of the edge element (3) is placed in the groove of respectively one of the two framework elements (4).

4. The wall construction panel (1) according to claim 1, wherein the grooves of the pillar element (2) and of the framework elements (4) pointing to the inside of the frame are configured respectively as undercut grooves.

5. The wall construction panel (1) according to claim 1, further comprising two connecting elements (6), and wherein the edge element (3) is connected with the two framework elements (4) with the two connecting elements (6), and each connecting element (6) is associated to exactly one framework element (4) and is placed with a first vertical holding section between the side walls (30) of the edge element (3) and is placed with a second vertical holding section inside the groove of the associated framework element (4).

6. The wall construction panel (1) according to claim 5, wherein, at least for one of the connecting elements (6), the first holding section (61) is fixed with a separate first fixing means to the edge element (3) and the second holding section (62) is fixed with a separate second fixing means to the associated framework element (4).

7. The wall construction panel (1) according to claim 5, wherein at least one of the connecting elements (6) has a cross-section configured with a T-shape perpendicularly to the horizontal direction (X), the T-shape is formed by a base beam (61) extending in the vertical direction (Y) and a crossbeam (62) extending in the transverse direction (Z), and the first holding section is configured as the base beam (61) and the second holding section as the crossbeam (62).

8. The wall construction panel (1) according to claim 5, wherein the first holding section of at least one of the connecting elements (6) has a bore (66) that is aligned with a through-hole (33) that is provided in a side wall (30) of the edge element (3), and the connecting element (6) is screwed to the edge element (3) with a screw (63) that extends through the through-hole (33) and into the bore (66).

9. The wall construction panel (1) according to claim 8, wherein the connecting element (6) has, in its section in which it has the bore (66), a thickness in the transverse direction of at least 3 mm, and the bore (66) has an inner thread into which the screw (63) is screwed.

10. The wall construction panel (1) according to claim 8, wherein the connecting element (6) has, in its section in which it has the bore (66), a thickness in the transverse direction of at least 4 mm, and the bore (66) has an inner thread into which the screw (63) is screwed.

11. The wall construction panel (1) according to claim 5, wherein for at least one of the connecting elements (6), the second holding section (62) has a stepped extension in the transverse direction on its side pointing to the edge element (3), the groove of the framework element (4) associated to this connecting element (6) is limited, on its side pointing to the frame inside, by two undercut sections (41, 42) forming an undercut that extend in the transverse direction and that form a groove opening between them, the second holding section (62) is placed in the groove opening with a central section (620) of its stepped extension and bears on the two undercut sections (41, 42) inside the groove with two lateral sections (621, 622) framing the central section, a fixing bore (65) with an inner thread is provided in the central section (620) and extends in the vertical direction (Y) through the central section (620), and a fixing screw (64) is screwed into the fixing bore (65), the fixing screw (64) that presses against a groove base facing the groove opening so that the fixing screw (64) presses the lateral sections (621, 622) against the undercut sections (41, 42).

12. The wall construction panel (1) according to claim 11, wherein for the at least one connecting element (6), a thickness in the transverse direction (Z) of the first holding section (61) decreases in the vertical direction (Y) upwards to the second holding section (62) over a step, and the fixing screw (64) is placed in the vertical direction (Y) above the step and in the transverse direction (Z) at least in sections at the level of the step.

13. The wall construction panel (1) according to claim 1, further comprising a spacer between the side walls (30) of the edge element (3) inside a vertical section that extends over half the vertical extension of the edge element (3) and that is spaced from the vertical ends of the edge element (3) by respectively one fourth of this vertical extension and is fixed to the side walls (30), the spacer that is spaced from the panel (5) in the horizontal direction (X) by less than 3 mm, wherein the spacer has a shape in the art of a cuboid, and the spacer has an extension length in the vertical direction (Y) of at least 50 mm.

14. The wall construction panel (1) according to claim 1, wherein the framework elements (4) have a hollow profile area extending throughout their horizontal extension, a clamp connector (7) is placed and fixed on each of the two horizontal ends of the two framework elements (4), both horizontal framework elements (4) are connected with the pillar element (2) respectively by one of their clamp connectors (7) and both horizontal framework elements (4) can be connected respectively by their other clamp connector (7) with a further pillar element (2) that has a receiving groove that is identical to the groove of the pillar element (2) of the wall construction panel (1) and that is adjacent with this receiving groove to the framework elements (4), and the edge element (3) is placed with its second horizontal section in this receiving groove of this further pillar element (2).

15. The wall construction panel (1) according to claim 1, further comprising a spacer between the side walls (30) of the edge element (3) inside a vertical section that extends over half the vertical extension of the edge element (3) and that is spaced from the vertical ends of the edge element (3) by respectively one fourth of this vertical extension and is fixed to the side walls (30), the spacer that is spaced from the panel (5) in the horizontal direction (X) by less than 3 mm, wherein the spacer has a shape in the art of a cuboid, and the spacer has an extension length in the vertical direction (Y) of at least 100 mm.

16. The wall construction panel (1) according to claim 1, further comprising a spacer between the side walls (30) of the edge element (3) inside a vertical section that extends over half the vertical extension of the edge element (3) and that is spaced from the vertical ends of the edge element (3) by respectively one fourth of this vertical extension and is fixed to the side walls (30), the spacer that is spaced from the panel (5) in the horizontal direction (X) by less than 3 mm and bears on the panel (5), wherein the spacer has a shape in the art of a cuboid, and the spacer has an extension length in the vertical direction (Y) of at least 50 mm.

17. The wall construction panel (1) according to claim 1, further comprising a spacer between the side walls (30) of the edge element (3) inside a vertical section that extends over half the vertical extension of the edge element (3) and that is spaced from the vertical ends of the edge element (3) by respectively one fourth of this vertical extension and is fixed to the side walls (30), the spacer that is spaced from the panel (5) in the horizontal direction (X) by less than 3 mm and bears on the panel (5).

18. A wall construction system comprising at least two wall construction panels (1) according to claim 1, wherein the pillar element (2) of a first of the wall construction panels (1) has a free receiving groove, the edge element (3) of a second of the wall construction panels (1) is placed in the receiving groove of the pillar element (2) of the first wall construction panel (1), and the framework elements (4) of the second wall construction panel (1) are connected with the pillar element (2) of the first wall construction panel (1).

19. A method for producing a wall construction panel, the method comprising: providing the wall construction panel (1) of claim 1, connecting the framework elements (4) with the pillar element (2), pushing the panel (5) in the horizontal direction (X) into the grooves of the framework elements (4) and into those of the pillar element (2), pushing a connecting element (6) respectively in the horizontal direction (X) into the groove respectively of one of the two framework elements (4) and is fixed in the groove, and pushing the edge element (3) in the horizontal direction (X) onto the connecting elements (6) and then fixing the connecting elements (6) to the edge element (3).

* * * * *